United States Patent [19]

Hargreaves et al.

[11] 4,378,271

[45] Mar. 29, 1983

[54] STARCH BOUND PAPER

[75] Inventors: Brian Hargreaves, Manchester; Robert A. Lancaster, Littleborough; Brian Healey, Rochdale; Alan K. Cousens, Cambridge, all of England

[73] Assignee: Turner & Newall PLC, Manchester, England

[21] Appl. No.: 195,834

[22] Filed: Oct. 10, 1980

[30] Foreign Application Priority Data

Oct. 19, 1979 [GB] United Kingdom ..... 7936392

[51] Int. Cl.[3] ..... D21H 5/18

[52] U.S. Cl. ..... 162/145; 162/146; 162/175; 162/181.6

[58] Field of Search ..... 162/145, 152, 175, 181 D, 162/156, 181.6, 146

[56] References Cited

U.S. PATENT DOCUMENTS

| | | | |
|---|---|---|---|
| 2,773,763 | 12/1956 | Scott | 92/3 |
| 3,379,609 | 4/1968 | Roberts | 162/181.6 |
| 3,470,062 | 9/1969 | Ollinger | 162/152 |
| 3,701,672 | 10/1972 | Ruff et al. | 162/14 S |
| 4,118,236 | 10/1978 | Erskine | 160/71 |
| 4,248,664 | 2/1981 | Atkinson et al. | 162/181 D |

FOREIGN PATENT DOCUMENTS

| | | | |
|---|---|---|---|
| 1107413 | 12/1963 | United Kingdom . | |
| 1093206 | 11/1967 | United Kingdom . | |
| 1263534 | 2/1972 | United Kingdom | 162/14 S |
| 1316244 | 5/1973 | United Kingdom . | |
| 1380442 | 1/1975 | United Kingdom . | |
| 1421556 | 1/1976 | United Kingdom | 162/14 S |
| 2001371 | 6/1978 | United Kingdom . | |
| 2020338 A | 11/1979 | United Kingdom . | |

OTHER PUBLICATIONS

Casey, *Pulp and Paper*, vol. III, (1961) p. 1314.

*Primary Examiner*—Peter Chin

*Attorney, Agent, or Firm*—Cushman, Darby & Cushman

[57] ABSTRACT

Non-asbestos alternatives to starch-bound asbestos papers comprise a matrix of unfired ball clay which is reinforced by vitreous fibres derived from wool-form materials and by organic web-forming fibres, the whole being bound together by hydrolysed starch.

1 Claim, No Drawings

STARCH BOUND PAPER

This invention relates to starch-bound paper, and provides non-asbestos alternatives to starch-bound asbestos papers.

Starch-bound asbestos papers contain asbestos fibres as the predominant raw material, these fibers being bound together with small amounts of hydrolysed starch to provide the necessary strength and flexibility. Such papers find use for a variety of purposes, e.g. as high temperature flexible insulation in electrical equipment. They are commonly made in the form of flexible sheet of thickness 0.1–1.5 mm on conventional paper-making machines such as the Fourdrinier. In the process an aqueous slurry of the ingredients which are to compose the product is progressively dewatered as a layer on a water-permeable conveyor (usually of wire mesh), the dewatered layer being subsequently compressed and dried.

According to the present invention, non-asbestos starch-bound paper comprises a matrix of unfired ball clay which is reinforced by vitreous fibres derived from wool-form material and by organic web-forming fibres, the whole being bound together by hydrolysed starch.

The ball clay, which in the unfired state is highly plastic, will ordinarily form from 45 to 70% by weight of the paper, and will accordingly form 45 to 70% by weight of the solids content of the aqueous slurry that is submitted to dewatering.

The function of the organic web-forming fibres is primarily to enable the paper to be formed on conventional paper-making machinery, but additionally those fibres impart strength to the ball clay matrix of the finished paper, just as the vitreous fibers derived from wool form material (the primary reinforcement) do. The organic web-forming fibres are preferably cellulose fibres, but may alternatively be polyethylene or polypropylene fibres of the kind commercially available under the name PULPEX. The organic web-forming fibres preferably form from 3 to 15% by weight of the finished paper. In the preparation of the aqueous slurry to be dewatered, the web-forming fibres are suitably employed at a freeness of 60°–90° Schopper-Riegler.

The reinforcing vitreous fibres, which are preferably present in an amount forming 20–40% by weight of the finished paper, are derived from wool-form material, such as mineral wool or glass wool. If glass wool is used, it is preferably employed in a form which has been treated with a silane coupling agent (i.e. gamma-aminopropyl triethoxysilane). Preferably, the wool-form vitreous fibre material employed has fibres which are predominantly of length in the range of 0.25–5 mm.

The hydrolysed starch suitably forms from 2 to 6% by weight of the paper. It is preferably a farina starch.

The paper may also contain a small proportion, suitably in the range 1–10%, of rayon fibres, to impart green strength to the sheet material between the dewatering and drying operations, and also to impart additional strength to the finished paper.

The density of the paper will ordinarily be in the range 600–10000 kg/m$^3$, its tensile strength at least 4 MPa and its burst strength at least 40 KPa.

The papers of the invention may be impregnated with other materials, such as resins, to give special properties for particular purposes. They may have surface coatings e.g. of shellac varnish or synthetic resin applied to them. They may also be given a backing e.g. of manilla paper, to increase mechanical strength, especially tensile strength, when that is required in the wrapping of conductors and the like, and they may be incorporated in double or multiple layer constructions with glass threads between adjacent paper layers to give particularly high strength, as when wrapping cables.

The invention is further illustrated by the following Example.

EXAMPLE

A. Preparation of stock i. Lapponia pulp (bleached softwood sulphate pulp) in sheet form was made into an aqueous slurry of solids content about 3% by weight and treated in a disc refiner until its freeness value was 90° Schopper Riegler.

ii. The pulp of i. (500 g. dry weight=16.7 kg wet weight) was added to 90 liters of water in a mixing tank, and the diluted pulp was agitated vigorously for 1 minute. There were then added, with vigorous stirring:

mineral wool free from 'shot' i.e. free from granular vitreous material; filament length 0.25–5 mm.

ball clay (90% passing a sieve of aperture 5 μm)

rayon fibre (3 denier; chopped to 3–8 mm fibre length)

farina starch (5% aqueous solution, prepared by heating at 100° C. for 5–10 minutes)

in proportions such that the solids content of the resulting slurry was made up of 30% vitreous fibres derived from mineral wool, 5% cellulose fibres, 56% unfired ball clay, 5% rayon fibres and 4% hydrolysed starch.

iii. The slurry of ii was diluted to 1–3% solids content.

B. Preparation of Paper

The stock (slurry) of A above was made into flexible sheet material in an entirely conventional way on a Fourdrinier flat wire paper machine, such as is described in chapters 10 and 11 of "Paper and Board Manufacture" by Julius Grant, James H. Young, and Barry G. Watson (Publishers; Technical Division, The British Paper and Board Industry Federation, London, 1978). The slurry is progressively dewatered as it travels on the water-permeable conveyor of the machine, and the dewatered material is consolidated by pressing between rollers, and then dried to low moisture content (suitably 2% by weight). The properties of the paper thus obtained were:

| | |
|---|---|
| Thickness | 0.25 mm |
| Density | 690 kg/m$^3$ |
| Mass per unit area ('substance') | 175 g/m$^2$ |
| Tensile Strength | |
| in machine direction | 8.25 MPa |
| across machine | 6.35 MPa |
| Burst Strength | 54 KPa |
| Ignition Loss | 18% |
| Flexibility Test | passed |

To pass the flexibility test referred to, a specimen of paper (50 mm×230 mm, with the 230 mm side parallel to the grain) should show no evidence of breaking when bent through 180° around a mandrel of 50 mm diameter, with use of just enough force to keep the specimen in contact with the mandrel.

We claim:

1. A non-asbestos flexible sheet material of thickness 0.1–0.5 mm comprising a matrix of unfired ball clay which is reinforced by (1) vitreous fibers derived from wool-form material, (2) rayon fibers as additional reinforcement, and by (3) cellulose web-forming fibers, the whole being bound together by hydrolyzed starch; said flexible sheet material being made by dewatering on a water-permeable conveyor a layer of aqueous slurry of unfired ball clay, wool-form vitreous fibers, cellulose web-forming fibers and hydrolyzed starch, and compressing and drying the dewatered layer; said aqueous slurry containing, by weight of solids content,

| | |
|---|---|
| ball clay | 45–70% |
| vitreous fibers | 20–40% |
| cellulose [organic] web-forming fibers of freeness 60–90° (Schopper-Riegler) | 3–15% |
| rayon fibers | 1–10% |
| hydrolyzed starch | 2–6% |

and said flexible sheet material having a degree of flexibility such that a specimen thereof measuring 50 mm×230 mm, with the 230 mm side parallel to the grain of the material, shows no evidence of breaking when bent through 180° around a mandrel of 50 mm diameter, with the use of just enough force to keep the specimen in contact with the mandrel.

* * * * *

UNITED STATES PATENT AND TRADEMARK OFFICE

CERTIFICATE OF CORRECTION

PATENT NO. : 4,378,271

DATED : March 29, 1983

INVENTOR(S) : Hargreaves, et al

It is certified that error appears in the above-identified patent and that said Letters Patent are hereby corrected as shown below:

Column 3, claim 1, line 2, delete [0.1-0.5 mm] and insert --0.1-1.5 mm--.

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*